US009194620B2

(12) United States Patent
McMasters et al.

(10) Patent No.: US 9,194,620 B2
(45) Date of Patent: Nov. 24, 2015

(54) METHODS AND SYSTEMS FOR REDUCING REFRIGERANT LOSS DURING AIR PURGE

(75) Inventors: Mark McMasters, Owatonna, MN (US); Dylan Lundberg, Lonsdale, MN (US)

(73) Assignee: SERVICE SOLUTIONS U.S. LLC, Wilmington, DE (US)

( * ) Notice: Subject to any disclaimer, the term of this patent is extended or adjusted under 35 U.S.C. 154(b) by 726 days.

(21) Appl. No.: 13/469,882

(22) Filed: May 11, 2012

(65) Prior Publication Data

US 2013/0298995 A1 Nov. 14, 2013

(51) Int. Cl.

| | |
|---|---|
| ***F25B 49/00*** | (2006.01) |
| ***F15D 1/00*** | (2006.01) |
| ***F25B 45/00*** | (2006.01) |
| *F25B 43/04* | (2006.01) |

(52) U.S. Cl.

CPC ..... *F25B 45/00* (2013.01); *F25B 43/04* (2013.01); *F25B 2345/003* (2013.01); *F25B 2345/0052* (2013.01); *Y10T 137/0318* (2015.04)

(58) Field of Classification Search

CPC .... F25B 45/00; F25B 43/04; F25B 2345/003; F25B 2345/0052; F25B 2345/002

USPC ..... 62/77, 126, 149, 292, 475; 137/1, 334

See application file for complete search history.

(56) References Cited

U.S. PATENT DOCUMENTS

| | | | | | |
|---|---|---|---|---|---|
| 5,005,375 | A * | 4/1991 | Manz et al. | ..... | 62/292 |
| 5,063,749 | A * | 11/1991 | Manz | ..... | 62/149 |
| 5,255,527 | A * | 10/1993 | Paige | ..... | 62/85 |
| 5,285,647 | A * | 2/1994 | Manz et al. | ..... | 62/127 |
| 5,369,959 | A * | 12/1994 | Pfefferle et al. | ..... | 62/195 |
| 5,493,869 | A * | 2/1996 | Shirley et al. | ..... | 62/149 |
| 5,517,825 | A | 5/1996 | Manz et al. | | |
| 5,544,492 | A * | 8/1996 | Manz | ..... | 62/85 |
| 5,758,506 | A | 6/1998 | Hancock et al. | | |
| 5,943,867 | A | 8/1999 | Thomas et al. | | |
| 6,134,899 | A | 10/2000 | Brown et al. | | |
| 6,202,433 | B1 * | 3/2001 | Murray et al. | ..... | 62/292 |
| 6,260,378 | B1 | 7/2001 | Sagar | | |
| 6,442,963 | B1 * | 9/2002 | Pfefferle et al. | ..... | 62/475 |
| 2003/0074909 | A1 | 4/2003 | Heiden et al. | | |
| 2005/0247070 | A1 * | 11/2005 | Arshansky et al. | ..... | 62/77 |
| 2007/0006609 | A1 * | 1/2007 | Thomas et al. | ..... | 62/475 |
| 2009/0241560 | A1 * | 10/2009 | Murray et al. | ..... | 62/77 |
| 2010/0326094 | A1 * | 12/2010 | Tandou et al. | ..... | 62/77 |

OTHER PUBLICATIONS

International Search Report mailed Sep. 9, 2013.

* cited by examiner

*Primary Examiner* — Mohammad M Ali

(74) *Attorney, Agent, or Firm* — Baker and Hostetler LLP

(57) ABSTRACT

A method of purging air from a tank includes opening, with a controller, a purging orifice on the tank to release a gas mixture contained within the tank, operating a timer to track multiple time intervals during which the purging orifice is open, each time interval having a beginning time and an ending time, determining an initial value of a system variable at each beginning time and a subsequent value of the system variable at each ending time, deriving a characteristic value of the gas mixture based on a change in the system variable from the initial value to the subsequent value measured over each time interval, and closing, with the controller, the purging orifice if a rate of change of the characteristic value over sequential time intervals is greater than or equal to a predetermined threshold rate of change value.

19 Claims, 9 Drawing Sheets

$$\frac{P_1V_1}{m_1RT_1} = \frac{P_2V_2}{m_2RT_2}$$

$$\frac{P_1}{T_1} = \frac{P_2}{T_2}$$

$$\frac{P_1V_1}{m_1RT_1} = \frac{P_2V_2}{m_2RT_2}$$

$$\frac{P_1}{m_1} = \frac{P_2}{m_2}$$

$$P_{total} = P_{ref} + P_{air}$$

$$\frac{P_{1,air}}{m_{1,air}} + \frac{P_{1,ref}}{T_{1,ref}} = \frac{P_{2,air}}{m_{2,air}} + \frac{P_{2,ref}}{T_{2,ref}}$$

METHODS AND SYSTEMS FOR REDUCING REFRIGERANT LOSS DURING AIR PURGE

FIELD OF THE DISCLOSURE

The disclosure generally relates to refrigerant recovery units, and, more particularly, to methods and systems for minimizing refrigerant loss during a purge process of a refrigerant recovery unit.

BACKGROUND OF THE DISCLOSURE

Vehicle air conditioning (A/C) systems are closed heat exchange systems designed to function with a specific refrigerant as the primary heat exchange medium. Refrigerants used in these systems include, dichlorodifluoromethane, commonly referred to as R-12, tetrafluoroethane, commonly referred to as R-134a, 2,3,3,3-tetrafluoropropene, or R-1234yf, and difluoroethane, or R-152a.

Refrigerant recovery units are used for the maintenance and servicing of vehicle A/C systems, which may include, for example, the recovery, evacuation, recycling and/or recharging of the refrigerant in the A/C systems. A refrigerant recovery unit may be a portable system that connects to the A/C system of a vehicle to recover refrigerant out of the system, separate out contaminants and oil, and/or recharge the A/C system with additional refrigerant.

When refrigerant from an A/C system is recovered by a refrigerant recovery unit, there is sometimes an amount of air recovered into the unit. As part of the recycling process, any recovered air is collected in the refrigerant storage tank of the refrigerant recovery unit and purged prior to the refrigerant being charged back into the A/C system. There is always some refrigerant that is lost along with the air being purged during the purge process. Typically, the amount of refrigerant lost is small because the amount of air that needs to be purged is small. However, as the amount of air that needs to be purged increases, the amount of refrigerant lost during the purge process increases. Due to the high cost of some of the newer refrigerants, such as R-1234yf, reducing the amount of refrigerant loss can have economic benefits to those providing A/C system services, as well as to the consumers of those services. In addition to the financial impact, there are also safety and environmental reasons to minimize refrigerant loss. For example, again in the case of R-1234yf, the refrigerant is flammable, so reducing the amount of refrigerant loss during the air purge process will reduce the likelihood of creating a hazardous situation. As for the environmental impact, all refrigerants have some environmental impact and there always exists a goal of minimizing or eliminating that impact.

A need exists for methods and systems that will minimize refrigerant loss during a purge process of the refrigerant recovery units.

SUMMARY OF THE DISCLOSURE

The foregoing needs are met by the present disclosure, wherein according to certain aspects, a method of purging air from a tank includes opening, with a controller, a purging orifice on the tank to release a gas mixture contained within the tank, operating a timer to track multiple time intervals during which the purging orifice is open, each time interval having a beginning time and an ending time, determining an initial value of a system variable at each beginning time and a subsequent value of the system variable at each ending time, deriving a characteristic value of the gas mixture based on a change in the system variable from the initial value to the subsequent value measured over each time interval, and closing, with the controller, the purging orifice if a rate of change of the characteristic value over sequential time intervals is greater than or equal to a predetermined threshold rate of change value.

In accordance with another aspect of the present disclosure, a refrigerant recovery unit includes a controller, a storage tank, and a purge apparatus having an orifice in fluid communication with the storage tank and operatively connected to the controller to expunge a gas mixture collected in the storage tank through the orifice during a discrete period of time, the discrete period of time being controlled by the controller and based upon measurement of a system variable and subsequent derivation of a characteristic value of the gas mixture based on the system variable, the discrete period of time ending when the rate of change of the characteristic value is greater than a predetermined threshold rate of change value at any time during the discrete period of time.

In accordance with yet other aspects of the present disclosure, a refrigerant recovery unit includes means for expunging a gas mixture collected in a storage tank during a discrete period of time, means for determining a rate of change of a characteristic value of the gas mixture, means for controlling the discrete period of time based on the rate of change of the characteristic value of the gas mixture.

There has thus been outlined, rather broadly, certain aspects of the present disclosure in order that the detailed description herein may be better understood, and in order that the present contribution to the art may be better appreciated.

In this respect, before explaining at least one embodiment of the invention in detail, it is to be understood that the invention is not limited in its application to the details of the construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE DISCLOSURE

The methods and systems disclosed herein enable precise tracking and control of critical variables during a refrigerant recovery and recycling process, which can, in turn, be used to determine when to stop an associated air purge process in order to minimize refrigerant loss.

Currently, the most common refrigerant used in vehicle refrigerant systems is HFC-134a. However, new refrigerants are being introduced in order to decrease global warming that can be caused by HFC-134a. These new refrigerants, for example, include HFO-1234yf and R-152a, and can also be used in the various embodiments described herein.

Figure 1:
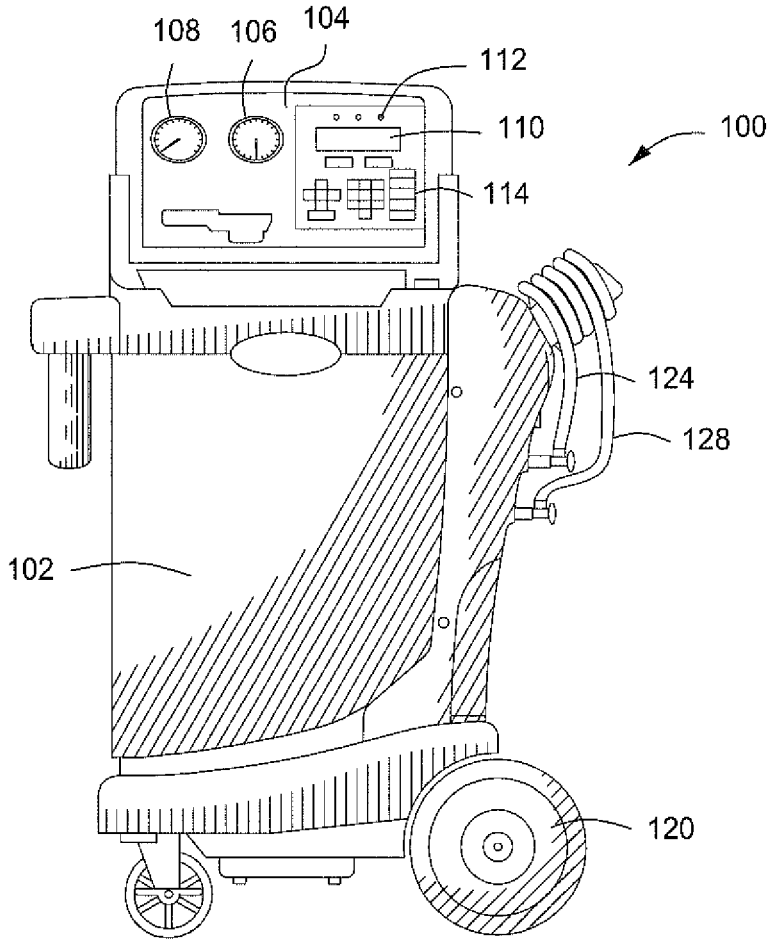
FIG. 1 is a perspective view of a refrigerant recovery unit in accordance with embodiments of the present disclosure.

FIG. 1 is a perspective view illustrating a refrigerant recovery unit 100 according to an embodiment of the present disclosure. The refrigerant recovery unit 100 can be the CoolTech 34788™ from Robinair™ based in Owatonna, Minn. (Service Solutions U.S. LLC). The refrigerant recovery unit 100 includes a cabinet 102 to house components of the system (See FIG. 2). The cabinet 102 may be made of any material such as thermoplastic, steel and the like.

The cabinet 102 includes a control panel 104 that allows the user to operate the refrigerant recovery unit 100. The control panel 104 may be part of the cabinet as shown in FIG. 1 or separated. The control panel 104 includes high and low gauges 106, 108, respectively. The gauges may be analog or digital as desired by the user. The control panel 104 has a display 110 to provide information to the user, such as certain operating status of the refrigerant recovery unit 100 or provide messages or menus to the user. Located near the display 110 are LEDs 112 to indicate to the user the operational status of the refrigerant recovery unit 100. A user interface 114 is also included on the control panel 104. The user interface 114 allows the user to interact and operate the refrigerant recovery unit 100 and can include an alphanumeric keypad and directional arrows.

Figure 2:
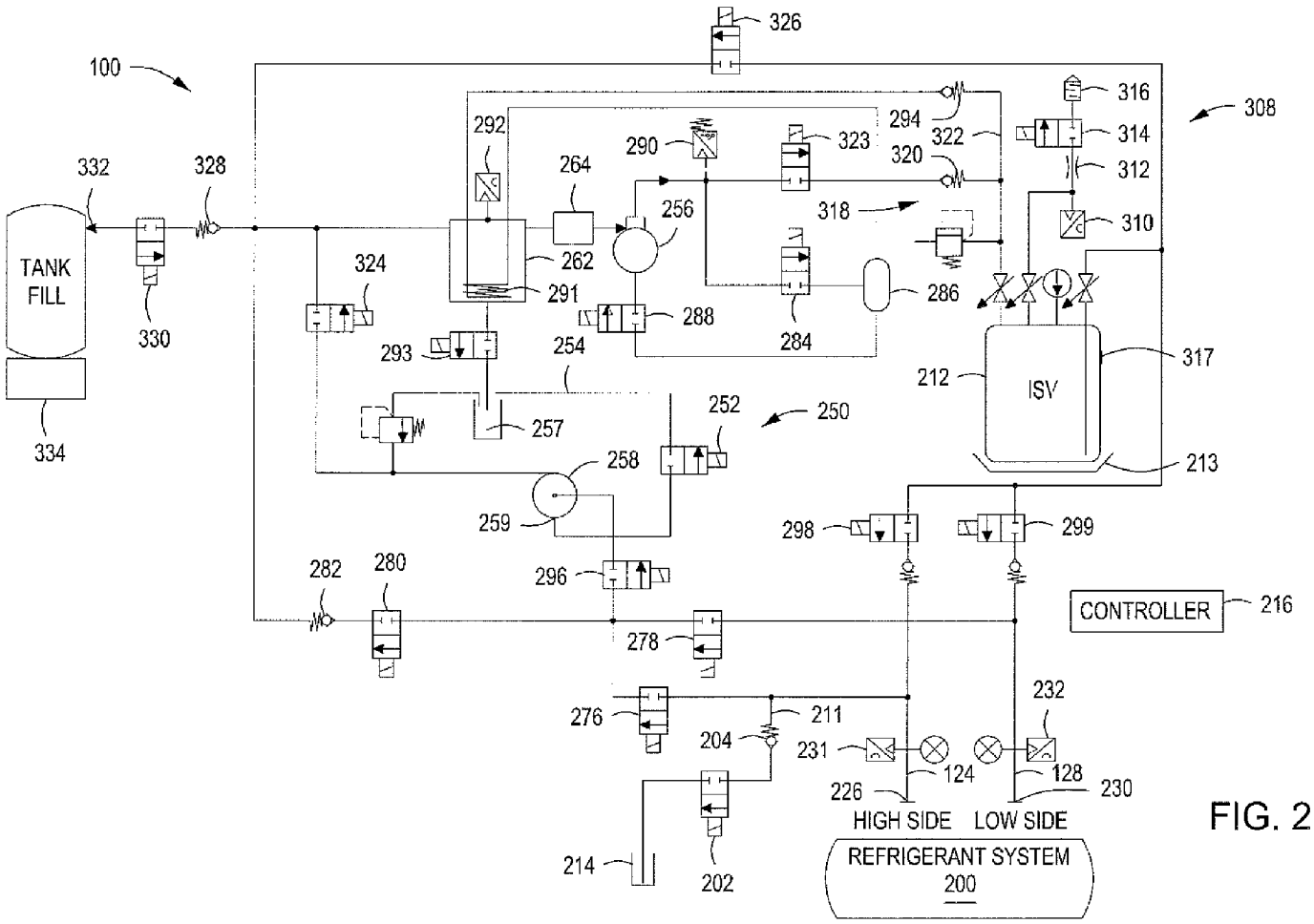
FIG. 2 illustrates components of the refrigerant recovery unit shown in FIG. 1 in accordance with embodiments of the present disclosure.

The cabinet 102 further includes connections for hoses 124, 128 that connect the refrigerant recovery unit 100 to a refrigerant containing device, such as the vehicle's refrigerant system 200 (shown in FIG. 2). In order for the refrigerant recovery unit 100 to be mobile, wheels 120 are provided at a bottom portion of the system.

FIG. 2 illustrates components of the refrigerant recovery unit 100 of FIG. 1 according to aspects of the present disclosure. In one embodiment, to recover refrigerant, service hoses 124 and 128 are coupled to the refrigeration system 200 of the vehicle, via couplers 226 (high side) and 230 (low side), respectively. The couplers are designed to be biased closed until they are coupled to the refrigerant system 200.

The refrigerant recovery cycle is initiated by the opening of high pressure and low-pressure solenoids 276, 278, respectively. This allows the refrigerant within the vehicle's refrigeration system 200 to flow through a recovery valve 280 and a check valve 282. The refrigerant flows from the check valve 282 into a system oil separator 262, where it travels through a filter/dryer 264, to an input of a compressor 256. Refrigerant is drawn through the compressor 256 through a normal discharge solenoid 284 and through a compressor oil separator 286, which circulates oil back to the compressor 256 through an oil return valve 288. The refrigerant recovery unit 100 may include a high-pressure switch 290 in communication with a controller 216, which is programmed to determine an upper pressure limit, for example, 435 psi, to optionally shut down the compressor 256 to protect the compressor 256 from excessive pressure. The controller 216 can also be, for example, a microprocessor, a field programmable gate array (FPGA) or application-specific integrated circuit (ASIC). The controller 216 via a wired or wireless connection (not shown) controls the various valves and other components (e.g. vacuum, compressor) of the refrigerant recovery unit 100. In some embodiments of the present disclosure, any or all of the electronic solenoid or electrically activated valves may be connected and controlled by the controller 216.

A high-side clear solenoid 323 may optionally be coupled to the output of the compressor 256 to release the recovered refrigerant transferred from compressor 256 directly into a refrigerant storage tank 212, instead of through a path through the normal discharge solenoid 284.

The heated compressed refrigerant exits the oil separator 286 and then travels through a loop of conduit or heat exchanger 291 for cooling or condensing. As the heated refrigerant flows through the heat exchanger 291, the heated refrigerant gives off heat to the cold refrigerant in the system oil separator 262, and assists in maintaining the temperature in the system oil separator 262 within a working range. Coupled to the system oil separator 262 is a switch or transducer 292, such as a low pressure switch or pressure transducer, for example, that senses pressure information, and provides an output signal to the controller 216 through a suitable interface circuit programmed to detect when the pressure of the recovered refrigerant is down to 13 inches of mercury, for example. An oil separator drain valve 293 drains the recovered oil into a container 257. Finally, the recovered refrigerant flows through a normal discharge check valve 294 and into the storage tank 212.

The evacuation cycle begins by the opening of high pressure and low-pressure solenoids 276 and 278 and valve 296, leading to the input of a vacuum pump 258. Prior to opening valve 296, an air intake valve (not shown) is opened, allowing the vacuum pump 258 to start exhausting air. The vehicle's refrigerant system 200 is then evacuated by the closing of the air intake valve and opening the valve 296, allowing the vacuum pump 258 to exhaust any trace gases remaining until the pressure is approximately 29 inches of mercury, for example. When this occurs, as detected by pressure transducers 231 and 232, optionally, coupled to the high side 226 and low side 230 of the vehicle's refrigeration system 200 and to the controller 216, the controller 216 turns off valve 296 and prepares for the recharging cycle.

High side clearing valves 318 may be used to clear out part of the high-pressure side of the system. The high side clearing valves 318 may include valve 323 and check valve 320. Valve 323 may be a solenoid valve. When it is desired to clear part of the high side, valve 323 is opened. Operation of the compressor 256 will force refrigerant out of the high pressure side through valves 323 and 320 and into the storage tank 212. During this procedure the normal discharge valve 284 may be closed.

A deep recovery valve 324 is provided to assist in the deep recovery of refrigerant. When the refrigerant from the vehicle's refrigeration system 200 has, for the most part, entered into the refrigerant recovery unit 100, the remaining refrigerant may be extracted from the vehicle's refrigeration system 200 by opening the deep recovery valve 324 and turning on the vacuum pump 258.

The recharging cycle begins by opening charge valve 298 to allow the refrigerant in storage tank 212, which is at a pressure of approximately 70 psi or above, to flow through the high side of the vehicle's refrigeration system 200. The flow is through charge valve 298 for a period of time programmed to provide a full charge of refrigerant to the vehicle. Optionally, charge valve 299 may be opened to charge the low side. The charge valve 299 may be opened alone or in conjunction with charge valve 298 to charge the vehicle's refrigerant system 200. The storage tank 212 may be disposed on a scale 213 that measures the weight of the refrigerant in the storage tank. The scale 213 may be operatively coupled to the controller 216 and provide a measurement of the weight of the storage tank 212 and/or any contents stored within the storage tank 212. Accordingly, weight data of the storage tank 212 and/or the contents stored within may be provided to the controller 216.

In another embodiment, alternatively in order to charge the refrigerant system 200, the power charge valve 326 may be opened and a tank fill structure 332 may be used. In order to obtain refrigerant from a refrigerant source, the refrigerant recovery unit 100 may include the tank fill structure 332, and valves 328 and 330. The tank fill structure 332 may be configured to attach to a refrigerant source. The valve 330 may be a solenoid valve and the valve 328 may be a check valve. In other embodiments, valve 330 may be a manually operated valve.

When it is desired to allow refrigerant from a refrigerant source to enter the refrigerant recovery unit 100, the tank fill structure 332 is attached to the refrigerant source and the tank fill valve 330 is opened. The check valve 328 prevents refrigerant from the refrigerant recovery unit 100 from flowing out of the refrigerant recovery unit 100 through the tank fill structure 332. When the tank fill structure 332 is not connected to a refrigerant source, the tank fill valve 330 is kept closed. The tank fill valve 330 may be connected to and controlled by the controller 216.

The tank fill structure 332 may be configured to be seated on the scale 334, which may be configured to weigh, for example, the tank fill structure 332 in order to determine an amount of refrigerant stored in the tank fill structure 332. The scale 334 may be operatively coupled to the controller 216 and provide a measurement of a weight of the tank fill structure 332 to the controller 216. The controller 216 may cause a display of the weight of the tank fill structure 332 on the display 110.

During the recovery and recycle process described above, air may be drawn into the refrigerant recovery unit 100, which can impact the efficiency and operation of the refrigerant recovery unit 100 and/or allow air to be passed into the vehicle's refrigerant system 200. As shown in FIG. 2, an air purging apparatus 308 allows the refrigerant recovery unit 100 to be purged of non-condensable, such as air, prior to the refrigerant being charged back into the A/C system. Air purged from the refrigerant recovery unit 100 may exit the storage tank 212, through an orifice 312, through a purging valve 314 and/or through an air diffuser 316. In some embodiments, the orifice may be about 0.028 of an inch. The valve 314 may be selectively actuated to permit or not permit the purging apparatus 308 to be open to the ambient conditions. A pressure transducer 310 may measure the pressure contained within the storage tank 212 and purge apparatus 308. The pressure transducer 310 may send the pressure information to the controller 216. For example, when the pressure is too high, as calculated by the controller, purging may be required and a signal may be sent to the controller 216 to initiate a purge process and/or signal that a purge is due at the next possible opportunity. In accordance with aspects of the present invention, the purge process may be automatically integrated by the controller 216 and appropriately scheduled at an appropriate time during the recovery and recycle process to avoid interfering with an ongoing procedure. Alternatively, the refrigerant recovery unit 100 may provide a signal to the user that one or more variables indicate the need for a purge of the storage tank 212, thus allowing the user to manually perform the purge process at the next appropriate time. In accordance with yet other aspects of the present invention, the control unit 216 may place a hold on the recovery and recycle process until a purge process is initiated if a reading of one of the critical variables indicates that the purge process is required.

In accordance with yet other aspects of the present invention, a temperature sensor 317 may be coupled to the refrigerant storage tank 212 to measure a temperature of the refrigerant therein. The placement of the temperature sensor 317 may be anywhere on the tank or alternatively, the temperature sensor may be placed within a refrigerant line 322.

Due to the difference in physical properties between a refrigerant, such as R-1234yf, and pure air, variables produced by one, the other, or a mixture of both can be used to control the amount of time for which air is purged from the refrigerant storage tank 212, ultimately minimizing the amount of refrigerant being leaked into the atmosphere as well as the amount of air in the refrigerant system. For example, by evaluating a particular critical variable over time, the purge process may be suspended when, for example, a particular threshold value of the critical variable is reached.

Figure 3:
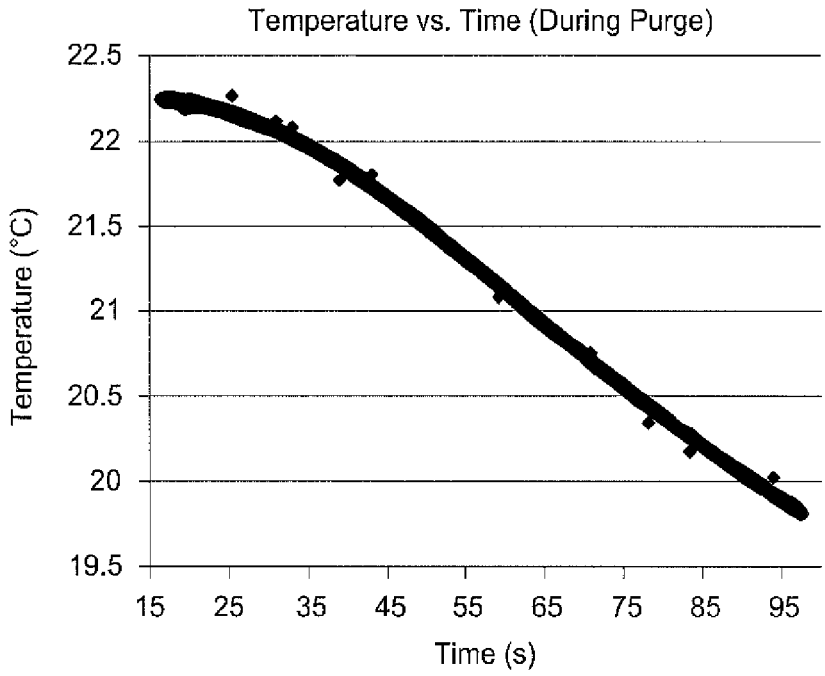
FIG. 3 illustrates a changing temperature over time graph for an exemplary purge process of an air-contaminated refrigerant storage tank in accordance with embodiments of the present disclosure.
Figure 4:
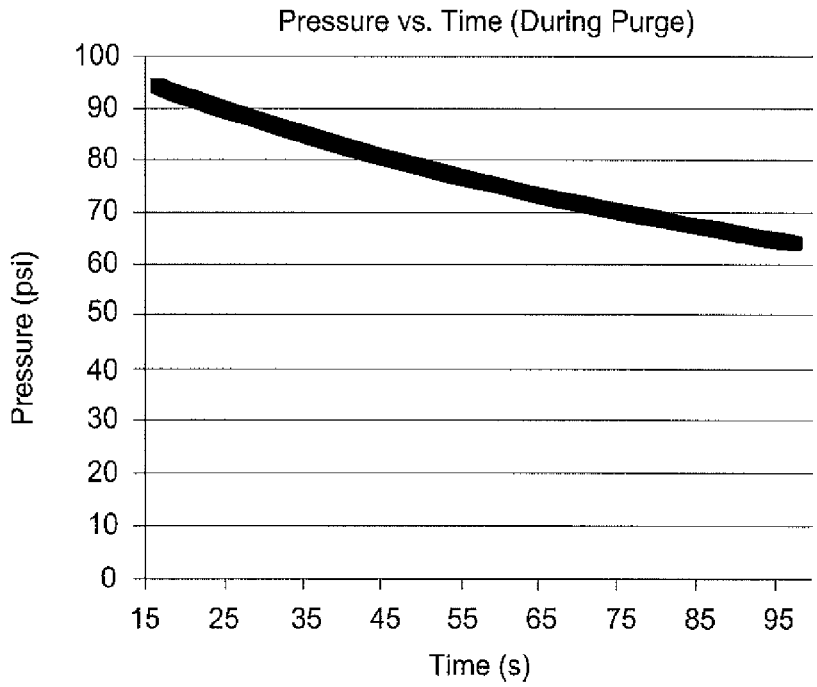
FIG. 4 illustrates a changing pressure over time graph for an exemplary purge process of an air-contaminated refrigerant storage tank in accordance with embodiments of the present disclosure.

For example, FIGS. 3 and 4 illustrate temperature and pressure measurements taken simultaneously over time during a purge process of an air-contaminated refrigerant storage tank. The purging orifice 312 of the purging apparatus 308 was opened at the 15 second mark of the purging process, which is illustrated as the time origin of the x-axis. The time interval between 15 and 30 seconds represents purging in which the vast majority of the gas being purged from a refrigerant recovery unit 100 is pure air. FIG. 3 illustrates that there is relatively small temperature drop and FIG. 4 illustrates that there is a relatively large pressure drop in comparison to the rest of the purge process during this time interval between 15 and 30 seconds. As time proceeds beyond the 15-30 second interval, a higher concentration of refrigerant is generally seen within the gas being purged. The higher concentration of refrigerant, in turn, causes a larger temperature drop and a more gradual pressure drop, as also seen in FIGS. 3 and 4.

The measured temperature and pressure may be used, for example, to calculate the ideal vapor pressure for the type of refrigerant used in the refrigerant recovery unit. The ideal vapor pressure may then be used to determine when the non-condensable gases need to be purged and how much purging will be done in order to get the refrigerant recovery unit to function properly. Various other methods and systems for measuring and evaluating one or more critical variables in order to accurately predict a time period for conducting the purge process are highlighted below.

Controlling Air Purge by Rate of Change in Mass

Mass flow rate, as defined in equation (1) below, is a change in mass over a time interval. During the purging of air from the system, the mass $$\dot{m} = \frac{\Delta m}{\Delta t} \tag{1}$$

of air (and/or refrigerant) lost from the system can be tracked by using the scale 213 on which the storage tank 212 sits ($m_{initial}-m_{final}$). By using a timer, initiated when the purge begins, the controller 216 may track an amount of time for the period during which the system is experiencing a mass loss. Knowing both of these variables, change in mass as well as change in time, a mass flow rate may be subsequently determined.

Equation (2) for choked mass flow rate of a gas through an orifice is shown below. By maintaining the pressure within the storage tank 212 at $$\dot{m} = C * A * \sqrt{k * \rho * P\left(\frac{2}{k+1}\right)^{\frac{k+1}{k-1}}} \tag{2}$$

approximately or greater than 1.9 times the atmospheric pressure, the equation above holds true. Equation (2) is dependent on three situational variables, which are C (discharge coefficient), A (cross sectional area of the orifice), and P (pressure inside the storage tank), as well as two physical property variables, which are k (specific heat) and p (density). It is due to the dependence on these physical property variables that a difference in mass flow rate between two gases, tested in identical situations, exists. Although the difference between the specific heat (k) of R1234yf, for example, and pure air is nearly negligible, their respective densities (ρ) are not. The densities of each are shown in Table 1 below.

TABLE 1

| Density @ 25° C., kg/m³ | |
|---|---|
| Air | 1.183 |
| HFO-1234yf | 35.135 |

Thus, the mass flow rates of pure air and pure R1234yf in identical scenarios is shown below:

$$\dot{m}_{air} = 0.8 * 0.1 * \sqrt{1.2 * 1.183 * 700{,}000\left(\frac{2}{1.2+1}\right)^{\frac{1.2+1}{1.2-1}}} = 6.013\frac{\text{kg}}{\text{s}}$$

$$\dot{m}_{1234yf} = 0.8 * 0.1 * \sqrt{1.2 * 35.135 * 700{,}000\left(\frac{2}{1.2}+1\right)^{\frac{1.2+1}{1.2-1}}} = 32.776\frac{\text{kg}}{\text{s}}$$

Although the above represents an extreme scenario of a sudden change from 100% air to 100% R1234yf, it can be seen that the differences in mass flow rates are quite significant. Thus, as a mixture of pure air and R1234yf becomes more R1234yf "heavy", the mass flow rate of the gas being purged proportionally increases.

Due to the significant difference in mass flow rates between air and a refrigerant, such as R1234yf, the amount of refrigerant leaving the orifice 312 with pure air may be minimized based solely on the mass flow rate being exhumed from the tank. As such, the mass flow rate may be tracked by continuously logging the mass of the storage tank 212 over a period of time. If air is the substantial constituent of the gas being purged, the mass flow rate should remain consistent, decreasing slowly due only to the pressure drop of the gas within the storage tank 212 (as it slowly equalizes with atmosphere). As the air becomes scarce and more vaporized refrigerant begins to be purged, an increase in mass loss will be seen, causing higher rates of mass flow. A predetermined threshold may be determined and implemented based on a set percentage amount, for example, of refrigerant within the gas being purged. Once the predetermined threshold of the mass flow rate of the purging gas is reached, the purge process may be discontinued.

Figure 5:
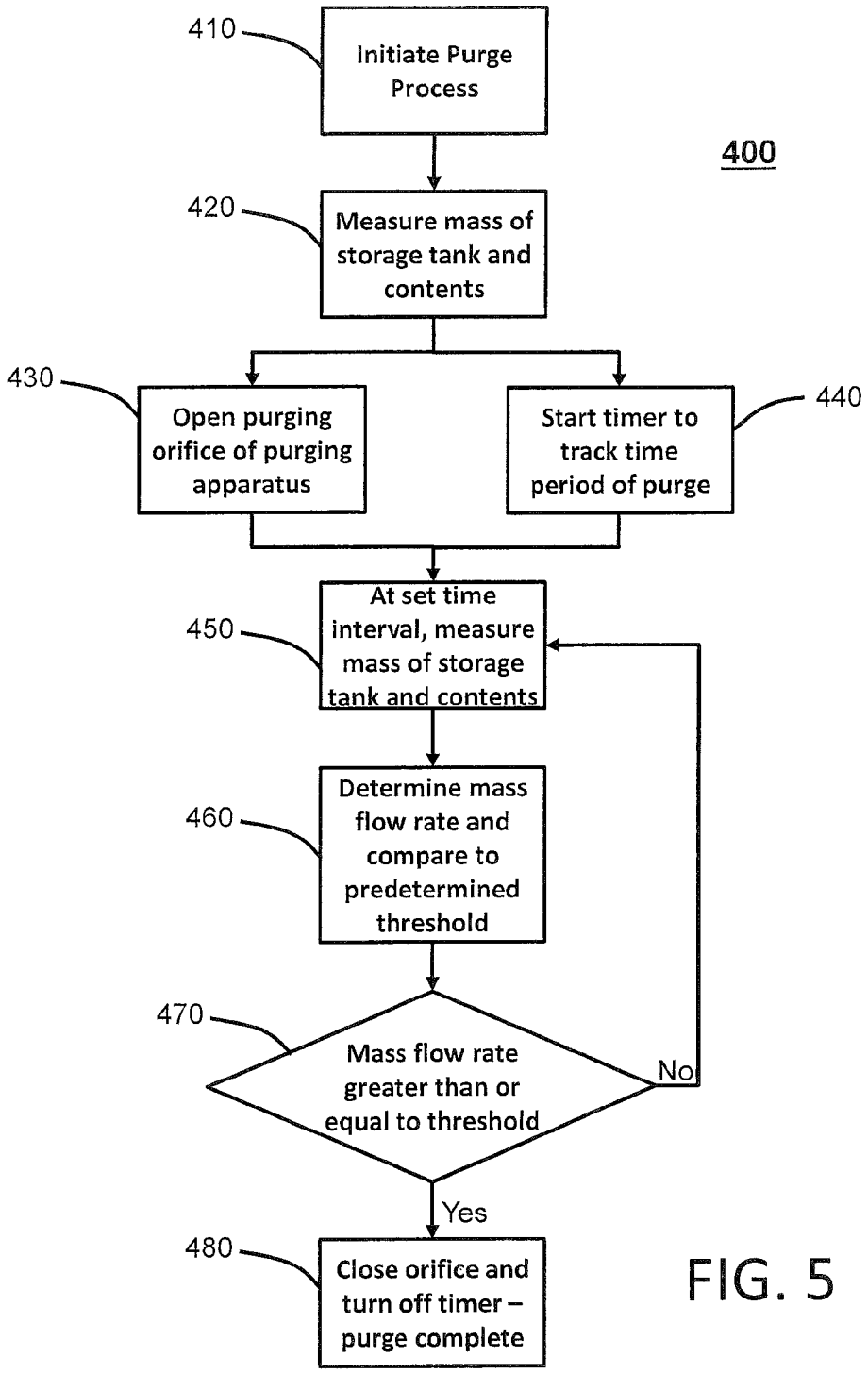
FIG. 5 is a flow diagram for controlling air purge by rate of change in mass in accordance with embodiments of the present disclosure.

FIG. 5 illustrates a flow diagram for a method of purging air 400 implemented on a refrigerant recovery unit 100. The method 400 shown in FIG. 5 may be executed or otherwise performed by one or a combination of various systems, including the system and components shown in FIGS. 1-2, by way of example. Various elements of the system shown in FIGS. 1-2 are referenced in explaining the exemplary method of FIG. 5. Each block shown in FIG. 5 represents one or more processes, methods, or subroutines carried out in exemplary method 400. However, certain steps may not have to be preformed in a certain order or performed at all.

The method 400 may be initiated either manually, or automatically via the controller 216, in response, for example, to a high pressure reading of the pressure transducer 310 and/or at an appropriate time during the overall recovery and recycle process of the refrigerant recovery unit 100. Block 410 illustrates that a determination has been made to initiate the purge process.

As shown in Block 420, the mass of the storage tank 212 and the contents therein, including, for example, stored refrigerant (liquid and/or vaporized) and any air, may be measured by the scale 213. Once a baseline mass measurement is recorded, as shown in Block 430, a signal may be sent by the controller 216, for example, to open the purging orifice 312 of the purging apparatus 308. Simultaneously, as shown in Block 440, a timer, implemented via the controller 216, for example, may be started to track the time that the orifice 312 is open and allowing gas to be purged from the storage tank 212. As shown at Block 450, after a set interval of time from the opening of the orifice 312, another measurement of the combined mass of the storage tank 212 and contents therein is recorded via the scale 213. As explained in detail above and illustrated by Block 460, the mass flow rate of the gas being expunged from the system is determined for the initial time interval and compared to the predetermined threshold value at which the percentage of refrigerant being expunged along with air is deemed unacceptable. As shown in Block 470, if the mass flow rate of the gas being expunged is greater than or equal to the predetermined threshold value, the controller 216 closes the orifice 312 and the timer is turned off, signaling the end of the purge process at Block 480. However, if the mass flow rate of the gas being expunged is less than the predetermined threshold value, indicating that the gas being purged from the storage tank 212 is substantially air, the process repeats beginning at Block 450 and the mass flow rate is determined for a subsequent interval of time and compared to the predetermined threshold value. The process is repeated until the threshold value is reached.

The set interval of time and subsequent time intervals may range from minute fractions of a second to a period of as long as five seconds, for example. Of course, shorter time intervals provide increased insight into the potentially changing mass flow rate, allowing for a more refined analysis and a greater likelihood that the purge process can be stopped as soon as the predetermined threshold value is realized.

In accordance with yet another embodiment of the present invention, the purge process may be configured to stop only upon two or more successive determinations of a mass flow rate at or below the predetermined threshold to prevent, for example, a single anomalous reading from prematurely suspending the purge process prior to the air being properly purged.

Controlling Air Purge by Density

As was discussed in the previous purging control method, the densities of a refrigerant, such as R1234yf, and pure air are significantly different. Thus, by calculating the density of the gas being purged, it is also possible to identify which gas: refrigerant, air, or a mixture, is actually being purged. As shown in equation (3) below, manipulation of the equation for mass flow of a choked gas through an orifice allows for the calculation of the density of the gas being purged. Equation (3) depends on determining the mass flow rate of the purging gas as well as the internal tank pressure of the $$\rho = \frac{\dot{m}^2}{c^2 * A^2 * k * p\left(\frac{2}{k+1}\right)^{\frac{k+1}{k-1}}} \tag{3}$$

storage tank 212. To determine the mass flow rate of the purging gas, two scale readings, an initial mass and a final mass may be taken at a timed interval as tracked by an internal timer, the first value being read at an initial time and the second value being read at a final time. Equation (1) may be used to determine the mass flow rate of the purging gas by taking the difference of the measured mass values taken over the timed interval, the timed interval being the difference between the final time and the initial time.

$$\dot{m} = \frac{\Delta m}{\Delta t} \tag{1}$$

For example, if the storage tank 212 weighed a total of 13.05 kg at time 0:00:01 and 13.00 kg at time 0:00:02, it can be seen that the tank lost 0.05 kg in a time frame of one total second. This is a mass flow rate of 0.05 kg/s. The instantaneous, internal pressure of the storage tank 212 may be continually relayed with a transducer. By knowing the mass flow rate and the internal pressure of the tank 212, as well as the physical dimensions of the orifice from which the gas is being purged, an accurate density can be calculated at any time interval. The calculated density can then be compared to the actual densities of pure air and pure refrigerant.

As shown in Table 2 below, based on an exemplary purge process, the densities of the purge gas may be calculated for two different periods of time calculated during the overall purge cycle.

TABLE 2

| Time Interval 1 | Time Interval 2 |
|---|---|
| Initial mass reading: 13.050 kg | Initial mass reading: 13.048 kg |
| Final mass reading: 13.049 kg | Final mass reading: 13.045 kg |
| Initial time: 00:00:00 | Initial time: 00:00:15 |
| Final time: 00:00:06 | Final time: 00:00:20 |
| Average pressure: 630,000 Pa | Average pressure: 600,000 Pa |
| Calculated Density: 1.3961 kg/m$^3$ | Calculated Density: 18.9977 kg/m$^3$ |

Example (assume tank temperature of 25° C.):

Table 2 illustrates that during Time Interval 1 the density is negligibly greater than the density of pure air, meaning that if any refrigerant is being purged, it is a minute amount. However, at Time Interval 2, it becomes clear that the density of the gas being relieved from the orifice is substantially greater than that of pure air, triggering a ceasing of the purge. The density and percent volume are proportional. Because of this, the percent volume of refrigerant in the purged gas can be determined according to equation (4) below.

$$\%\ Volume_{1234yf} = \frac{\rho_{mixture}}{\rho_{1234yf} - \rho_{air}} * 100 \tag{4}$$

A predetermined threshold of maximum allowable percent volume of refrigerant may be preprogrammed and/or manually input to the refrigerant recovery unit 100, for example, and the ceasing of the purge may be based on the predetermined threshold value.

Figure 6:
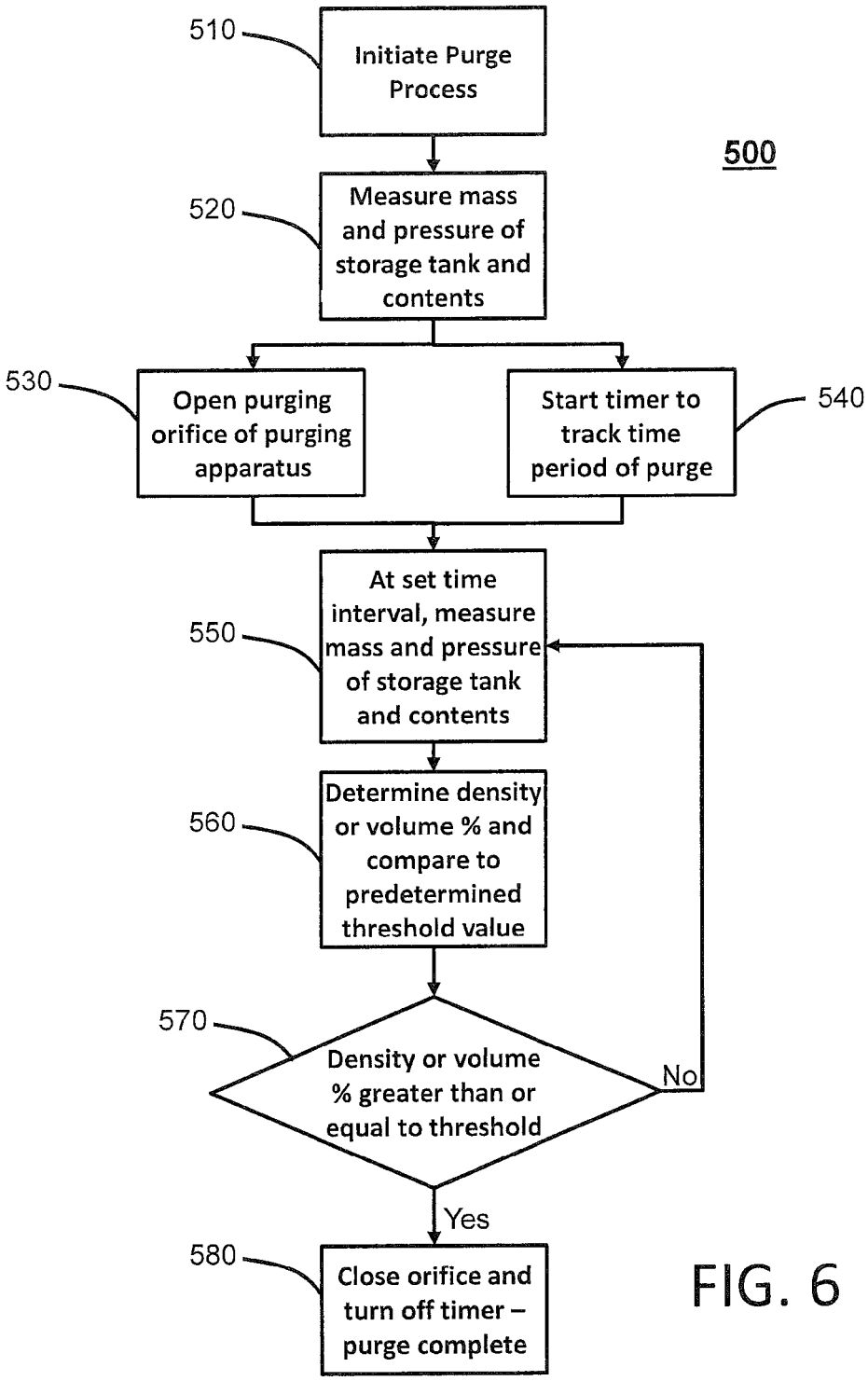
FIG. 6 is a flow diagram for controlling air purge by density in accordance with embodiments of the present disclosure.

FIG. 6 illustrates a flow diagram for a method of purging air 500 implemented on a refrigerant recovery unit 100. The method 500 shown in FIG. 5 may be executed or otherwise performed by one or a combination of various systems, including the system and components shown in FIGS. 1-2, by way of example. Various elements of the system shown in FIGS. 1-2 are referenced in explaining the exemplary method of FIG. 6. Each block shown in FIG. 6 represents one or more processes, methods, or subroutines carried out in exemplary method 500.

The method 500 may be initiated either manually, or automatically via the controller 216, in response, for example, to a high pressure reading of the pressure transducer 310 and/or at an appropriate time during the overall recovery and recycle process of the refrigerant recovery unit 100. Block 510 illustrates that a determination has been made to initiate the purge process.

As shown in Block 520, the mass of the storage tank 212 and the contents therein, including, for example, stored refrigerant (liquid and/or vaporized) and any air, may be measured by the scale 213. The pressure of the storage tank 212 may also be measured by the pressure transducer 310. Once these baseline measurements are recorded, as shown in Block 530, a signal may be sent by the controller 216, for example, to open the purging orifice 312 of the purging apparatus 308. Simultaneously, as shown in Block 540, a timer, implemented via the controller 216, for example, may be started to track the time that the orifice 312 is open and allowing gas to be purged from the storage tank 212. As shown at Block 550, after a set interval of time from the opening of the orifice 312, another measurement of the combined mass of the storage tank 212 and contents therein is recorded via the scale 213. An average pressure over the time interval may be determined by continually relaying pressure measurements from the pressure transducer 310 and calculating the average pressure over the time interval.

As explained in detail above and illustrated by Block 560, the average density of the gas being expunged from the system may be determined for the initial time interval by using the mass flow rate and pressure measurements in equation (3). The average density may be compared to a predetermined threshold value at which the density of the combined refrigerant and air being expunged is deemed unacceptable. Alternatively, by using equation (4), the calculated density may be used to determine the volume percentage of refrigerant in the gas being expunged, wherein a volume percentage above a predetermined threshold value would trigger the end of the purge process. As shown in Block 570, if the density, or alternatively the volume percentage of refrigerant, in the gas being expunged, is greater than or equal to the predetermined threshold value for density or volume percentage, the controller 216 closes the orifice 312 and the timer is turned off, signaling the end of the purge process. However, if the density of the gas being expunged or the volume percentage of refrigerant in the gas being expunged is less than the respective predetermined threshold values, indicating that the gas being purged from the storage tank 212 is substantially air, the process repeats, beginning at Block 550, and the density or volume percentage is determined for a subsequent interval of time and compared again to the predetermined threshold value(s). The process is repeated until the threshold value of the appropriate variable is reached.

The initial time interval and/or subsequent time intervals may range from minute fractions of a second to a period of as long as five seconds, for example. Of course, shorter time intervals provide increased insight into the potentially changing average density of the gas being expunged, allowing for a more refined analysis and a greater likelihood that the purge process can be stopped as soon as the predetermined threshold value is realized.

In accordance with yet another embodiment of the present invention, the purge process may be configured to stop only upon two or more successive determinations of an average density at or below the predetermined threshold to prevent, for example, a single anomalous reading from prematurely suspending the purge process prior to the air being properly purged.

Controlling Air Purge by Rate of Change in Temperature

As a volume of refrigerant is purged through an orifice, a cooling effect is seen, particularly in the vapor space in the storage tank 212. This cooling effect causes a temperature drop within the container enclosing the refrigerant. This is the same effect witnessed within a refrigeration or air conditioning cycle. Refrigerant cools surrounding areas as it evaporates. A closed tank containing refrigerant will continue to boil liquid refrigerant until it eventually reaches its temperature dependent saturation pressure within the tank. If any refrigerant is lost at this point, the liquid refrigerant will once again begin to evaporate until that saturation pressure is met again.

As noted above, evaporation of the refrigerant produces a cooling effect. The same effect is not realized for pure air. As a container of pure air is purged through a small orifice, the temperature within the container drops by a negligible amount. This factual difference between how refrigerant and air react in the same situation can be utilized to assist in controlling the air purge process. As shown in equation (5) below, as a container full of air is being purged, the mass loss is solely reflected in a drop in pressure.

$$\frac{P_1 * V}{\frac{m_1}{M} * R * T} = \frac{P_2 * V}{\frac{m_2}{M} * R * T} \rightarrow \frac{P_1}{m_1} = \frac{P_2}{m_2} \tag{5}$$

Based on this observation, as soon as a temperature decline begins within the storage tank 212 undergoing a purge, it can be assumed that it is no longer pure air being purged. The amount of refrigerant within the purged air can also be determined based on the rate at which the temperature is declining. As the refrigerant partial volume increases, a higher $\Delta T/\Delta t$ (rate of temperature change), can be seen. This is due to the boiling of a higher concentration of refrigerant which amplifies the refrigerant's cooling effect as it is purged. As the rate of temperature decline reaches a point where a predetermined critical ratio of refrigerant to air has been reached, the purging may be ceased. This method will prevent excess refrigerant from leaving the storage tank 212, while exhuming as much pure air as possible.

Figure 7:
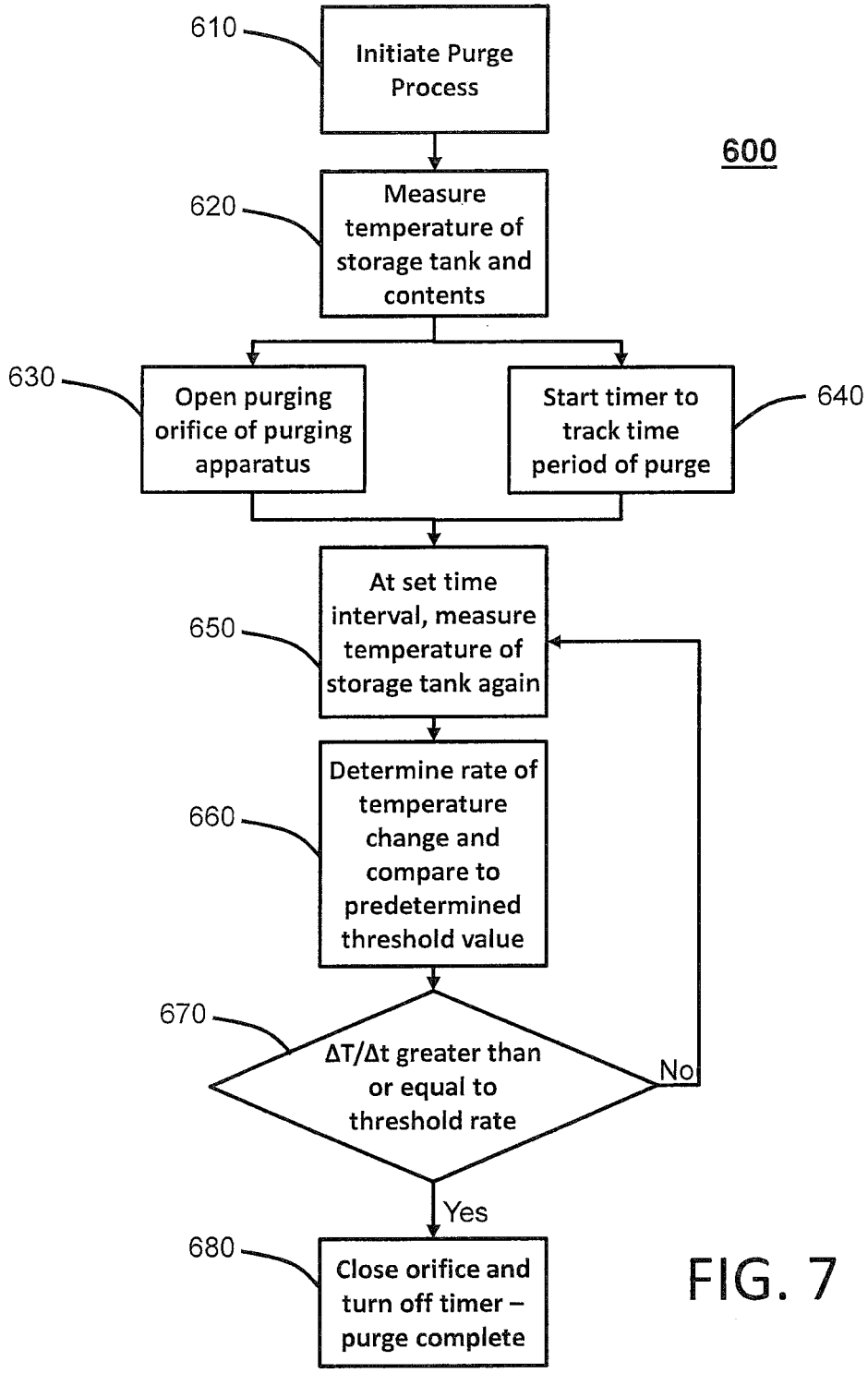
FIG. 7 is a flow diagram for controlling air purge by rate of change in temperature in accordance with embodiments of the present disclosure.

FIG. 7 illustrates a flow diagram for a method of purging air 600 implemented on a refrigerant recovery unit 100. The method 600 shown in FIG. 7 may be executed or otherwise performed by one or a combination of various systems, including the system and components shown in FIGS. 1-2, by way of example. Various elements of the system shown in FIGS. 1-2 are referenced in explaining the exemplary method of FIG. 7. Each block shown in FIG. 7 represents one or more processes, methods, or subroutines carried out in exemplary method 600.

The method 600 may be initiated either manually, or automatically via the controller 216, in response, for example, to a high pressure reading of the pressure transducer 310 and/or at an appropriate time during the overall recovery and recycle process of the refrigerant recovery unit 100. Block 610 illustrates that a determination has been made to initiate the purge process.

As shown in Block 620, the temperature of the storage tank 212 may be measured by the temperature sensor 317. Once the baseline temperature measurement is recorded, as shown in Block 630, a signal may be sent by the controller 216, for example, to open the purging orifice 312 of the purging apparatus 308. Simultaneously, as shown in Block 640, a timer, implemented via the controller 216, for example, may be started to track the time that the orifice 312 is open and allowing gas to be purged from the storage tank 212. As shown at Block 650, after a set interval of time from the opening of the orifice 312, another temperature measurement of the storage tank 212 and contents may be made. As explained in detail above and illustrated by Block 660, the rate of change of the temperature of the gas in the storage tank 212 may be determined for the initial time interval and compared to a predetermined threshold value. As shown in Block 670, if the rate of change of the temperature of the gas in the storage tank 212 is greater than or equal to the predetermined threshold value, the controller 216 closes the orifice 312 and the timer is turned off, signaling the end of the purge process. However, if the rate of change of the temperature of the gas in the storage tank 212 is less than the respective predetermined threshold value, indicating that the gas being purged from the storage tank 212 is substantially air, the process repeats beginning at Block 650 and the temperature rate of change is recorded over a subsequent interval of time and compared again to the predetermined threshold value. The process is repeated until the threshold value of the rate of temperature change is reached indicating that the amount of refrigerant in the air being purged is above the predetermined limit.

The initial time interval and/or subsequent time intervals may range from minute fractions of a second to a period of as long as five seconds, for example. Of course, shorter time intervals provide increased insight into the rate that the temperature is changing over time as gas is being expunged, allowing for a more refined analysis and a greater likelihood that the purge process can be stopped as soon as the predetermined threshold value is realized.

In accordance with yet another embodiment of the present invention, the purge process may be configured to stop only upon two or more successive determinations of an average density at or below the predetermined threshold to prevent, for example, a single anomalous reading from prematurely suspending the purge process prior to the air being properly purged.

percentage of air mass lost while purging, is fractionally greater than the temperature decline seen while purging refrigerant. Through lab testing at 22° C., it was seen that the rate of temperature drop during the purging of pure refrigerant was on average, 0.008° C./second. However, purging pure air through an orifice with a diameter of 6.604×10-4 m, with initial tank values of 22° C. and 7.0 bar, produces a mass flow rate of 0.912 grams/second. In regard to the total mass of gas and the total temperature of gas within the tank, a mass loss of 0.912 grams/second is more significant than the temperature loss. This in turn creates a more significant drop in pressure. The scenario is outlined in Example 1 below:

Example 1

| Initial Tank Values | |
|---|---|
| $T_o$ = | 22.0° C. |
| $m_{o,air}$ = | 115 grams |
| $P_o$ = | 7.0 bar = 700,000 Pa |
| $\dot{m}$ = | 0.912 g/s (assume mass flow rate remains constant) |
| $\Delta T/\Delta t$ = | .008° C./s |
| $\Delta t$ = | 10 seconds |

| Purging Pure Air | Purging Pure Refrigerant |
|---|---|
| $\frac{P_1}{m_1} = \frac{P_2}{m_2}$ | $\frac{P_1}{T_1} = \frac{P_2}{T_2}$ |
| $\frac{700{,}000}{115} = \frac{P_2}{115 - (10 * 0.912)}$ | $\frac{700{,}000}{22.0} = \frac{P_2}{22.0 - (10 * .008)}$ |
| $P_2 = 644{,}487\ \text{Pa} \rightarrow \frac{\Delta P}{\Delta t} = 5{,}551.3\ \text{Pa/s}$ | $P_2 = 697{,}455\ \text{Pa} \rightarrow \frac{\Delta P}{\Delta t} = 254.5\ \text{Pa/s}$ |

Controlling Air Purge by Rate of Change in Pressure

Figure 8:
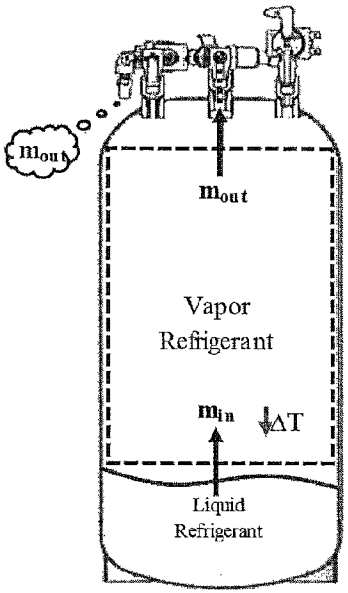
FIG. 8 illustrates an exemplary storage tank full of pure refrigerant (liquid and vapor) in accordance with embodiments of the present disclosure.
Figure 9:
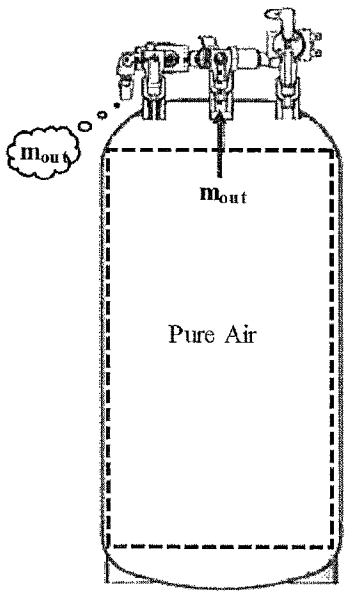
FIG. 9 illustrates an exemplary storage tank full of pure air in accordance with embodiments of the present disclosure.
Figure 10:
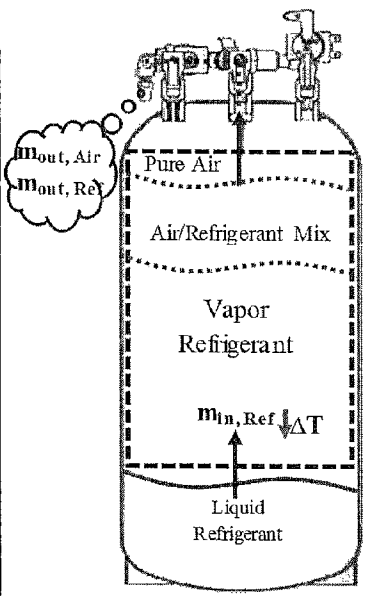
FIG. 10 illustrates an exemplary storage tank containing a mix of refrigerant and air in accordance with embodiments of the present disclosure.

As illustrated in FIGS. 8-10, the rate at which the pressure of the storage tank 212 declines while undergoing a purge can be accurately differentiated between a tank full of pure refrigerant and a tank containing a mixture of refrigerant and air. As shown in FIG. 8, in which no contaminants exist within a tank of pure refrigerant, as long as there is still liquid refrigerant to be boiled within the tank, the mass loss of physical refrigerant vapor has no effect on the internal pressure of the tank. This is due to the capability of the refrigerant, through boiling, to replenish the lost vapor faster than a small orifice can purge it. However, due to the cooling effect described in the previous purge-control method, a small pressure drop is indeed seen. This pressure drop is again associated with the ideal gas law. The pressure loss is directly proportional to the loss in temperature. If the rate at which the temperature of the tank declines due to the cooling effect of refrigerant evaporation can be accurately estimated and treated as a constant, the proportional rate of declination in pressure may also be known. This rate can then act as an ideal milestone, representing the rate of pressure drop produced from purging a tank containing 100% refrigerant. Therefore, if a tank's internal pressure is dropping faster than the ideal rate, a determination may be made that there is also air in the tank. This is because pure air does not act in the same fashion as pure refrigerant. The air is not re-saturated, and therefore, there is no significant cooling effect witnessed. If purging pure air, as shown in FIG. 9, a loss in pressure is directly proportional to the loss in physical mass.

A tank purging pure air will lose pressure significantly faster than a tank purging pure refrigerant. This is because the Example 1 illustrates quite clearly the difference in rates of pressure drop when purging a tank of pure air versus purging a tank of pure refrigerant. This information can be utilized to control the air purge of the storage tank 212. For example, given an identical scenario to that seen in Example 1, if the rate of pressure drop is near the value of 5,550 Pascals per second, purging of the storage tank 212 is allowed to continue because the system can determine that the gas being exhumed from the tank is pure air or substantially pure air. On the contrary, if the rate of pressure drop is falling from that value, a determination is made that refrigerant is also being purged. As shown in FIG. 10, for example, the amount of refrigerant within the gas mixture can be estimated through proportionality between a theoretical pure air rate of pressure drop and a theoretical pure refrigerant rate of pressure drop. In the scenario of Example 1, if the rate of pressure drop was found to be 2,900 Pa/s over a time interval, the amount of refrigerant being purged could be estimated at being 50% of the gas mixture. The purging process may thus be ceased depending on a pre-determined allowable percentage of refrigerant within the gas mixture being purged.

Figure 11:
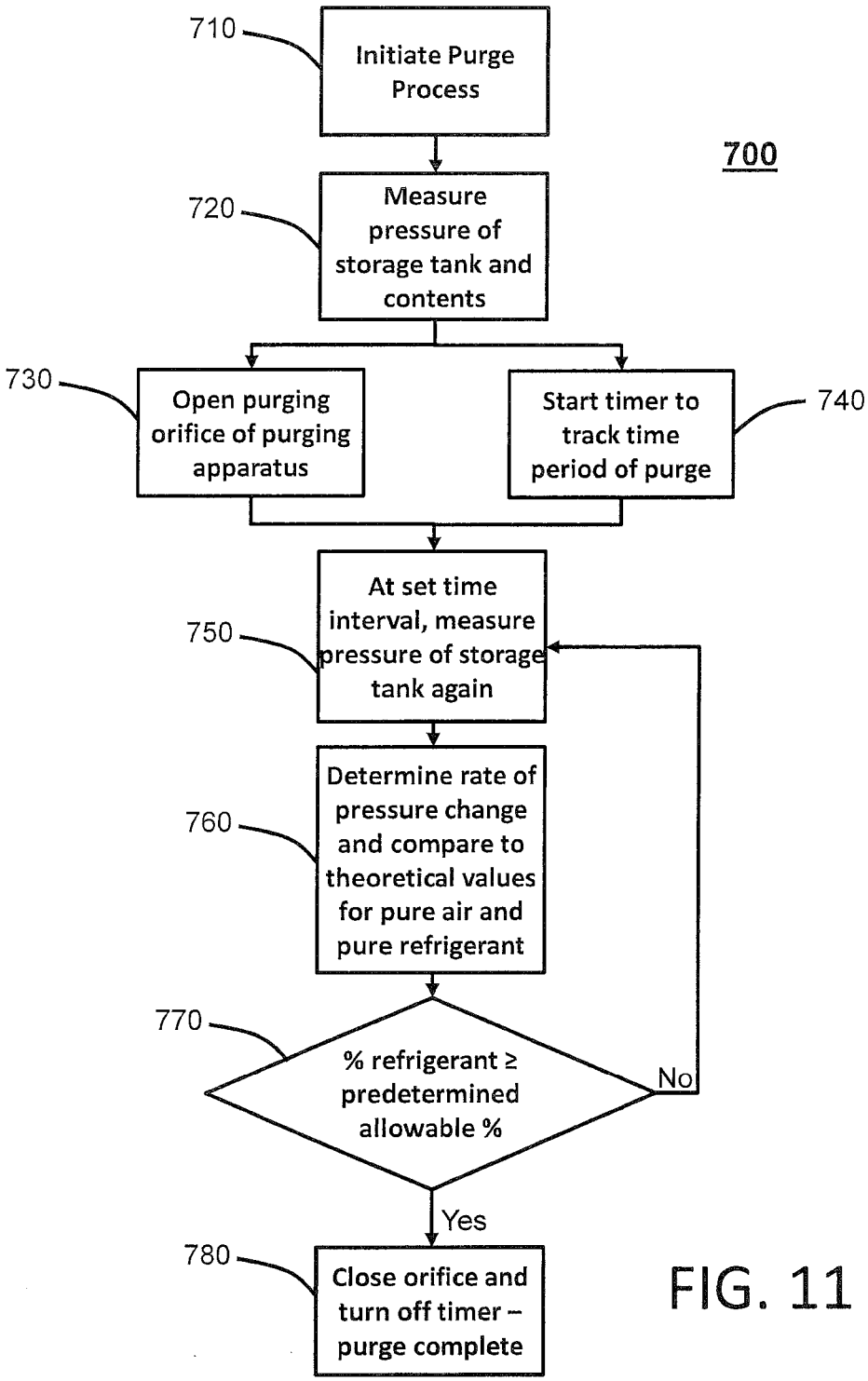
FIG. 11 is a flow diagram for controlling air purge by rate of change in pressure in accordance with embodiments of the present disclosure.

FIG. 11 illustrates a flow diagram for a method of purging air 700 implemented on a refrigerant recovery unit 100. The method 700 shown in FIG. 11 may be executed or otherwise performed by one or a combination of various systems, including the system and components shown in FIGS. 1-2, by way of example. Various elements of the system shown in FIGS. 1-2 are referenced in explaining the exemplary method of FIG. 11. Each block shown in FIG. 11 represents one or more processes, methods, or subroutines carried out in exemplary method 700.

The method 700 may be initiated either manually, or automatically via the controller 216, in response, for example, to a high pressure reading of the pressure transducer 310 and/or at an appropriate time during the overall recovery and recycle process of the refrigerant recovery unit 100. Block 710 illustrates that a determination has been made to initiate the purge process.

As shown in Block 720, the pressure of the gas to be expunged may be measured by the pressure transducer 310. Once the baseline pressure measurement is recorded, as shown in Block 730, a signal may be sent by the controller 216, for example, to open the purging orifice 312 of the purging apparatus 308. Simultaneously, as shown in Block 740, a timer, implemented via the controller 216, for example, may be started to track the time that the orifice 312 is open and allowing gas to be purged from the storage tank 212. As shown at Block 750, after an initial set interval of time from the opening of the orifice 312, another pressure measurement of the gas may be made. As explained in detail above and illustrated by Block 760, the rate of change of the pressure of the gas in the storage tank 212 may be determined for the initial time interval and compared to the theoretical values of pressure change if the gas in the storage tank 212 was pure air or pure refrigerant. As shown in Block 770, if a determination is made that, based on the pressure drop readings, the percentage of refrigerant within the gas mixture is above a predetermined allowable percentage threshold value, the controller 216 closes the orifice 312 and the timer is turned off, signaling the end of the purge process. However, if the rate of change of the pressure drop indicates that the percentage of refrigerant in the gas mixture is less than the respective predetermined threshold value, the process repeats beginning at Block 750 and the change in pressure is recorded over a subsequent interval of time so that the percentage of refrigerant in the gas mixture can be determined for the subsequent interval of time and compared again to the predetermined threshold value. The process is repeated until the threshold value of the rate of pressure change is reached indicating that the percentage amount of refrigerant in the air being purged is above the predetermined percentage threshold.

The initial time interval and/or subsequent time intervals discussed above may range from minute fractions of a second to a period of as long as five seconds, for example. Of course, shorter time intervals provide increased insight into the rate that the pressure is changing over time as gas is being expunged, allowing for a more refined analysis and a greater likelihood that the purge process can be stopped as soon as the predetermined percentage threshold value is realized.

In accordance with yet another embodiment of the present invention, the purge process may be configured to stop only upon two or more successive determinations of the percentage amount of refrigerant in the air, based on the rate of change of the pressure, at or below the predetermined threshold to prevent, for example, a single anomalous reading from prematurely suspending the purge process prior to the air being properly purged.

Figure 12:
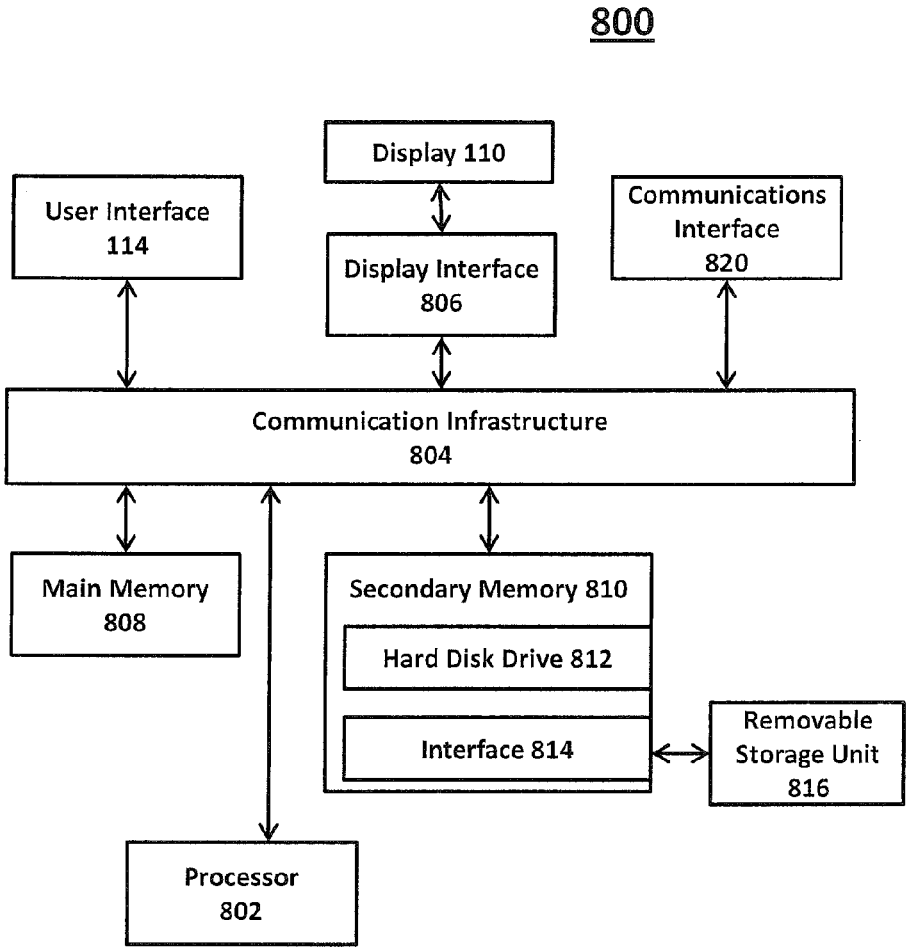
FIG. 12 is a schematic illustrating aspects of a control system, in accordance with embodiments of the present disclosure.

Aspects of the refrigerant recovery unit and the purging processes discussed above may be implemented via control system 800 using software or a combination of software and hardware. In one variation, aspects of the present invention may be directed toward a control system 800 capable of carrying out the functionality described herein. An example of such a control system 800 is shown in FIG. 12.

Control system 800 may be integrated with the controller 216 to permit, for example, automation of the recovery, evacuation, purging, and recharging processes and/or manual control over one or more of each of the processes individually. The control system 800 may also provide access to a configurable database of vehicle information so the specifications pertaining to a particular vehicle or refrigerant, for example, may be used to provide exacting control and maintenance of the functions described herein. The control system 800 may include a processor 802 connected to a communication infrastructure 804 (e.g., a communications bus, cross-over bar, or network). The various software and hardware features described herein are described in terms of an exemplary control system. A person skilled in the relevant art(s) will realize that other computer related systems and/or architectures may be used to implement the aspects of the disclosed invention.

The control system 800 may include a display interface 806 that forwards graphics, text, and other data from memory and/or the user interface 114, for example, via the communication infrastructure 804 for display on the display 110. The communication infrastructure 804 may include, for example, wires for the transfer of electrical, acoustic and/or optical signals between various components of the control system and/or other well-known means for providing communication between the various components of the control system, including wireless means. The control system 800 may include a main memory 808, preferably random access memory (RAM), and may also include a secondary memory 810. The secondary memory 810 may include a hard disk drive 812 or other devices for allowing computer programs or other instructions and/or data to be loaded into and/or transferred from the control system 800. Such other devices may include an interface 814 and a removable storage unit 816, including, for example, a Universal Serial Bus (USB) port and USB storage device, a program cartridge and cartridge interface (such as that found in video game devices), a removable memory chip (such as an erasable programmable read only memory (EPROM), or programmable read only memory (PROM)) and associated socket, and other removable storage units 816 and interfaces 814.

The control system 800 may also include a communications interface 820 for allowing software and data to be transferred between the control system 800 and external devices. Examples of a communication interfaces include a modem, a network interface (such as an Ethernet card), a communications port, wireless transmitter and receiver, Bluetooh, Wi-Fi, infra-red, cellular, satellite, a Personal Computer Memory Card International Association (PCMCIA) slot and card, etc.

A software program (also referred to as computer control logic) may be stored in main memory 808 and/or secondary memory 810. Software programs may also be received through communications interface 820. Such software programs, when executed, enable the control system 800 to perform the features of the present invention, as discussed herein. In particular, the software programs, when executed, enable the processor 802 to perform the features of the present invention. Accordingly, such software programs may represent controllers of the control system 800.

In variations where the invention is implemented using software, the software may be stored in a computer program product and loaded into control system 800 using hard drive 812, removable storage drive 816, and/or the communications interface 820. The control logic (software), when executed by the processor 802, causes the controller 216, for example, to perform the functions of the invention as described herein. In another variation, aspects of the present invention can be implemented primarily in hardware using, for example, hardware components, such as application specific integrated circuits (ASICs) or field programmable gate arrays (FPGA). Implementation of the hardware state machine so as to perform the functions described herein will be apparent to persons skilled in the relevant art(s).

It can be understood that the methods and systems for minimizing refrigerant loss during a purge process of a refrigerant recovery unit described and illustrated herein are examples only. The methods and apparatuses described herein can be used for any refrigerant including R-1234yf, however, the present disclosure can also be used for $CO_2$, and other similar refrigerant systems. It is contemplated and within the scope of the disclosure to construct a wide range of refrigerant recovery units to meet particular design and requirements in a wide range of applications.

It is to be understood that any feature described in relation to any one aspect may be used alone, or in combination with other features described, and may also be used in combination with one or more features of any other of the disclosed aspects, or any combination of any other of the disclosed aspects.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A method of purging air from a tank, the method comprising the steps of:

opening, with a controller, a purging orifice on the tank to release a gas mixture contained within the tank;

operating a timer to track multiple time intervals while the purging orifice is open, each time interval having a beginning time and an ending time;

determining an initial value of a system variable at each beginning time and a subsequent value of the system variable at each ending time;

deriving a characteristic value of the gas mixture based on a change in the system variable from the initial value to the subsequent value measured over each time interval the system variable being based on a measurement of at least one of a temperature sensor coupled to the tank and a scale the tank sits on;

determining a rate of change of the characteristic value over subsequent time intervals of the multiple time intervals; and closing, with the controller, the purging orifice if the rate of change of the characteristic value over sequential the subsequent time intervals is greater than or equal to a predetermined threshold rate of change value.

2. The method according to claim 1, wherein the system variable is a mass of the gas mixture in the tank, and the mass is measured using the scale FE the tank sits on.

3. The method according to claim 2, wherein the characteristic value is a mass flow rate of the gas mixture, the mass flow rate of the gas mixture being calculated based on a change in the mass, measured using the scale, over a corresponding time interval.

4. The method according to claim 2 further comprising the step of:

continuously measuring a pressure of the gas mixture to derive an average pressure over each time interval.

5. The method according to claim 4, wherein the characteristic value is an average density of the gas mixture derived from the average pressure and the change in the system variable over the time interval.

6. The method according to claim 4, wherein the characteristic value is a volume percentage of a refrigerant in the gas mixture derived from the average pressure and the change in the system variable over the time interval.

7. The method according to claim 1, wherein the system variable is a temperature of the gas mixture in the tank, and the temperature is measured using the temperature sensor coupled to the tank.

8. The method according to claim 7, wherein the characteristic value is a temperature differential of the gas mixture, the temperature differential being calculated based on a change in the temperature, measured using the temperature sensor, over a corresponding time interval.

9. The method according to claim 1, wherein the system variable is a pressure of the gas mixture.

10. The method according to claim 9, wherein the characteristic value is a volume percentage of a refrigerant in the gas mixture.

11. A refrigerant recovery unit comprising:

a controller;

a storage tank; and a purge apparatus having an orifice in fluid communication with the storage tank and operatively connected to the controller to expunge a gas mixture collected in the storage tank through the orifice during a discrete period of time, the discrete period of time being controlled by the controller and based upon measurement of a system variable and subsequent derivation of a characteristic value of the gas mixture based on the system variable, the discrete period of time ending when the system variable being based on a measurement of at least one of a temperature sensor coupled to the storage tank and a scale the storage tank sits on, wherein the discrete period of time including multiple time intervals, and wherein the controller is configured to close the orifice when a rate of change of the characteristic value over at least one time interval of the multiple time intervals is greater than a predetermined threshold rate of change value at any time during the discrete period of time.

12. The refrigerant recovery unit according to claim 11, wherein the system variable is a mass of the gas mixture in the tank measured using the scale the tank sits on, and the characteristic value is a mass flow rate of the gas mixture calculated based on a change in the mass over a corresponding time interval.

13. The refrigerant recovery unit according to claim 11, further comprising:

a pressure transducer for measuring a pressure of the gas mixture.

14. The refrigerant recovery unit according to claim 13, wherein the characteristic value is an average density of the gas mixture derived from an average pressure.

15. The refrigerant recovery unit according to claim 13, wherein the system variable is a pressure of the gas mixture.

16. The refrigerant recovery unit according to claim 15, wherein the characteristic value is a volume percentage of a refrigerant in the gas mixture derived from a rate of change of the pressure of the gas mixture.

17. The refrigerant recovery unit according to claim 11, further comprising:

a temperature sensor coupled to the tank to measure a temperature of the gas mixture.

18. The refrigerant recovery unit according to claim 17, wherein the system variable is the temperature of the gas mixture and the characteristic value is a temperature differential of the gas mixture calculated based on a change in the temperature over a corresponding time interval.

19. A refrigerant recovery unit comprising:

means for expunging a gas mixture collected in a storage tank during a discrete period of time, the discrete period of time including multiple time intervals;

means for determining a rate of change of a characteristic value of the gas mixture over a time interval of the multiple time intervals; and means for controlling the discrete period of time based on the rate of change of the characteristic value of the gas mixture over the time interval of the multiple time intervals.

* * * * *